US006646856B2

(12) United States Patent
Lee et al.

(10) Patent No.: US 6,646,856 B2
(45) Date of Patent: Nov. 11, 2003

(54) APPARATUS FOR REMOVING STATIC ELECTRICITY USING HIGH-FREQUENCY HIGH AC VOLTAGE

(75) Inventors: Tong Young Lee, Kyungki-do (KR); Yeo Song Yun, Kyungki-do (KR); Jae Hun Oh, Kyungki-do (KR); Eui Kyeong Choi, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/135,523

(22) Filed: May 1, 2002

(65) Prior Publication Data

US 2003/0007307 A1 Jan. 9, 2003

(30) Foreign Application Priority Data

Jul. 3, 2001 (KR) ..... 2001-39421

(51) Int. Cl.[7] ..... H05F 3/04
(52) U.S. Cl. ..... 361/232; 361/235
(58) Field of Search ..... 361/212, 220, 361/231, 232, 235; 250/325, 326

(56) References Cited

U.S. PATENT DOCUMENTS 4,271,451 A * 6/1981 Metz ..... 361/213
4,415,947 A * 11/1983 Dryczynski et al. ..... 361/235
4,757,422 A * 7/1988 Bossard et al. ..... 361/231
5,057,966 A * 10/1991 Sakata et al. ..... 361/213
5,542,964 A * 8/1996 Kroeger et al. ..... 95/6
5,636,011 A 6/1997 Fujiwara et al.
6,205,309 B1 * 3/2001 Gundlach et al. ..... 399/170

* cited by examiner

*Primary Examiner*—Kim Huynh
(74) *Attorney, Agent, or Firm*—Lowe Hauptmann Gilman & Berner LLP

(57) ABSTRACT

A static electricity removal apparatus capable of raising an alternating rate at which ions are generated according to the speed of an object requiring static electricity removal using a high-frequency high voltage AC voltage includes: at least one discharge electrode assembly having a plurality of needle-shaped electrodes aligned with each other, each needle-shaped electrode receiving the high-frequency high voltage AC voltage and generating ions using a corona discharge; a ground electrode for facilitating ion generation by the plurality of needle-shaped electrodes; a high-frequency high voltage generation unit connected to the at least one discharge electrode assembly, the voltage generation unit generating the high-frequency high voltage AC voltage outputted to the plurality of needle-shaped electrodes; and an ion blower adapted to blow ions from the plurality of needle-shaped electrodes to the object requiring static electricity removal.

7 Claims, 8 Drawing Sheets

APPARATUS FOR REMOVING STATIC ELECTRICITY USING HIGH-FREQUENCY HIGH AC VOLTAGE

BACKGROUND OF THE INVENTION

1. Field of the Invention

The present invention relates to an apparatus for removing static electricity using a high-frequency high voltage alternating current (AC) voltage, and more particularly to a static electricity removal apparatus which is capable of generating ions at an alternating rate according to a moving speed of an object requiring static electricity removal using the high-frequency high voltage AC voltage, thereby enhancing the static electricity removal efficiency.

2. Description of the Related Art

Generally, in a capacitor fabrication process, a high insulation film (for example, a polypropylene film or the like) is subjected to coating with a high dielectric material while being fed at a high speed using a roller. During this process, when friction and separation occur between the film and the roller guiding the film, a high-level level electrostatic voltage (a maximum of 20,000V) may be generated, resulting in a reduction in work efficiency. For this reason, an apparatus for removing static electricity has been used.

The conventional static electricity removal apparatus may, for example, be an ionizer using a commercial AC voltage or a direct current (DC) pulse voltage. However, where the insulation film is treated at a high speed, even after the ionizer has removed the static electricity, a residual electrostatic voltage of a maximum of 7,000V may still remain. Thus, the static electricity removal efficiency of the conventional static electricity removal apparatus is low.

To enhance the static electricity removal efficiency, it is necessary to remove the static electricity in accordance with a moving speed of the object requiring static electricity removal. However, ions are generated at a low alternating rate in the conventional static electricity removal apparatus because it uses the commercial AC voltage or the DC pulse voltage, resulting in an inadequate removal of static electricity.

SUMMARY OF THE INVENTION

Therefore, the present invention has been made in view of the above problems, and it is an object of the present invention to provide a static electricity removal apparatus suitable for charged object moving at a high speed, which is capable of raising an alternating rate at which ions are generated in accordance with the speed of the charged object using a high-frequency high voltage AC voltage, resulting in an increased static electricity removal efficiency.

In accordance with the present invention, the above and other objects can be accomplished by the provision of a static electricity removal apparatus comprising at least one discharge electrode assembly including a plurality of needle-shaped electrodes aligned with each other, the plurality of needle-shaped electrodes receiving a high-frequency high AC voltage and generating ions using a corona discharge; a ground electrode spaced apart from the discharge electrode assembly by a certain interval, the ground electrode facilitating ion generation by the plurality of needle-shaped electrodes; a high-frequency high voltage generation unit directly connected to the discharge electrode assembly, the voltage generation unit generating the high-frequency high voltage AC voltage outputted to the plurality of needle-shaped electrodes; and an ion blower adapted to blow ions from the discharge electrodes to an object requiring static electricity removal.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

The present invention provides a static electricity removal apparatus using a high-frequency high voltage AC voltage, in which a high-frequency high voltage AC voltage of a frequency of 17 KHz and a maximum voltage of 7000 Volts is generated and then applied to at least one discharge electrode assembly. Hereinafter, a description will be given of the static electricity removal apparatus on the basis of two embodiments, air-blowing and bar types.

Figure 1:
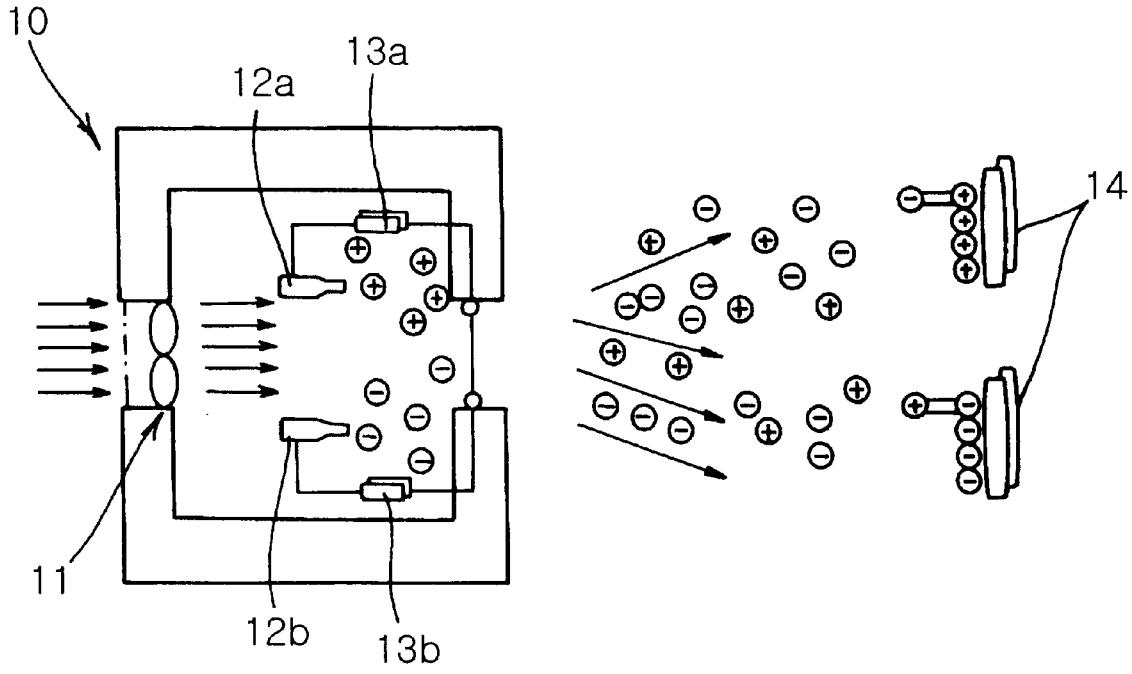
FIG. 1 is a cross sectional view of a static electricity removal apparatus using a high-frequency high AC voltage in accordance with an embodiment of the present invention.

FIG. 1 is a cross sectional view of a static electricity apparatus of an air-blowing type in accordance with a preferred embodiment of the present invention.

As shown in this drawing, the static electricity removal apparatus 10 according to the present invention comprises a fan 11, first and second discharge electrode assemblies 12*a* and 12*b*. The removal apparatus 10 further comprises first and second high-frequency high voltage generation units 13*a* and 13*b* for applying a high-frequency high voltage to the discharge electrode assemblies 12*a* and 12*b*. The fan 11 is arranged behind the first and second discharge electrode assemblies 12*a* and 12*b*. Each of the discharge electrode assemblies 12*a* and 12*b* has a plurality of needle-shaped electrodes that are aligned with each other. Further, the discharge electrode assemblies 12*a* and 12*b* are respectively placed in upper and lower parts of the removal apparatus 10 to be opposed to each other.

The first and second high-frequency high voltage generation units 13*a* and 13*b* which are an important feature of the present invention act to generate a high-frequency high voltage and apply the generated high-frequency high voltage to each of the needle-shaped electrodes of each of the discharge electrode assemblies 12*a* and 12*b* such that a corona discharge occurs around each of the needle-shaped electrodes to generate ions. There is an advantage in that ions are generated at a high alternating rate in the above manner due to the voltage of a high frequency. Finally, the generated ions are moved to charged objects 14 by the fan 11 arranged behind the first and second discharge electrode assemblies 12*a* and 12*b*, thereby effectively removing static electricity on the charged objects 14 even while the charged objects 14 move at high speeds.

Figure 2:
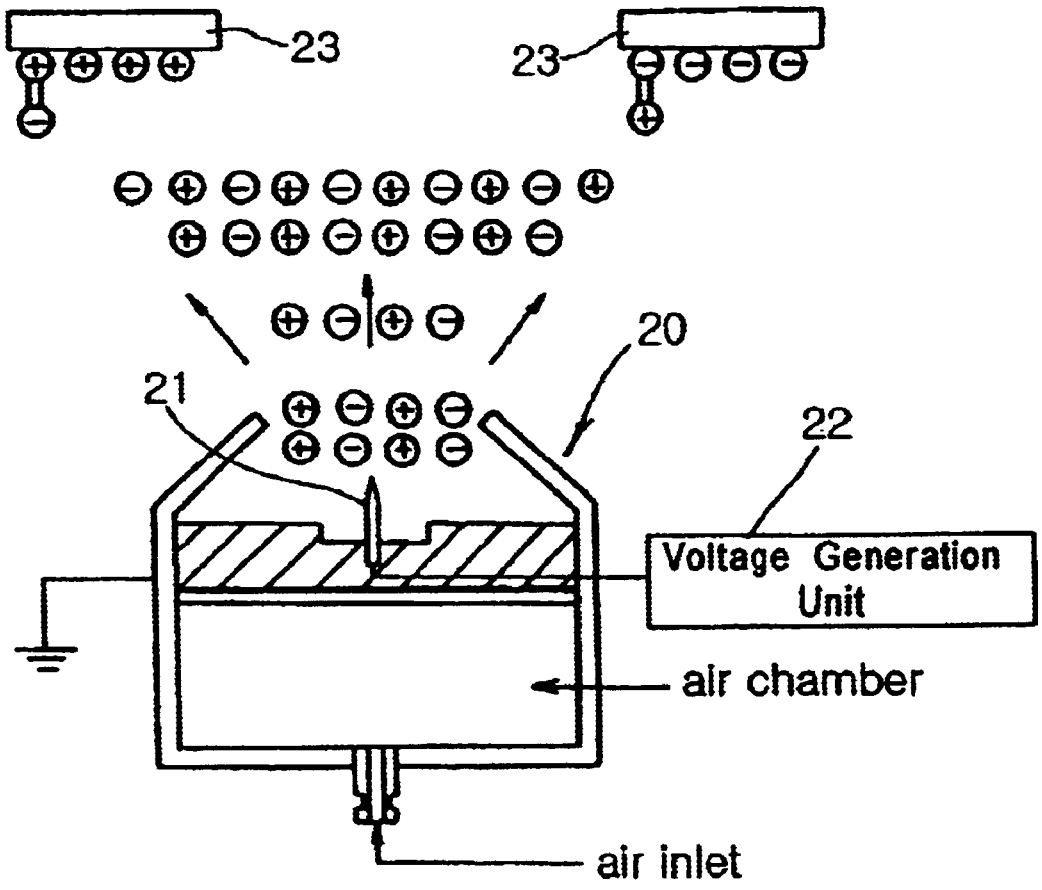
FIG. 2 is a cross sectional view of a static electricity removal apparatus using a high-frequency high AC voltage in accordance with another embodiment of the present invention.

FIG. 2 is a cross sectional view of a static electricity removal apparatus of a bar type which is capable of performing a static electricity removal operation using pressurized air instead of a fan in order to reduce its size in accordance with another preferred embodiment of the present invention. As shown in this drawing, the bar type removal apparatus 20 comprises an air chamber defined in such a way as to communicate with an air inlet defined on a lower surface thereof. The bar type removal apparatus 20 is configured to supply air to the air chamber through the air inlet until air pressure within the air chamber becomes relatively high and to move ions to a charged objects 23 using the force of the air pressure which has become relatively high.

The bar type static electricity removal apparatus 20 further comprises a discharge electrode assembly 21 placed between the air inlet and an ion outlet, which includes a plurality of needle-shaped electrodes aligned with each other and spaced at regular intervals, and a high-frequency high voltage generation unit 22 for applying a high-frequency high voltage to each of the needle-shaped electrodes of the discharge electrode assembly 21.

The high-frequency high voltage generation unit 22 generates a high-frequency high AC voltage of a frequency of 17 KHz and a maximum voltage of 7000 Volts according to the present invention. Then, the voltage generation unit 22 applies the generated high-frequency high AC voltage to each of the needle-shaped electrodes of the discharge electrode assembly 21 such that a corona discharge occur using the applied AC voltage to generate ions, thereby achieving a high alternating rate of ion generation.

Figure 3A:
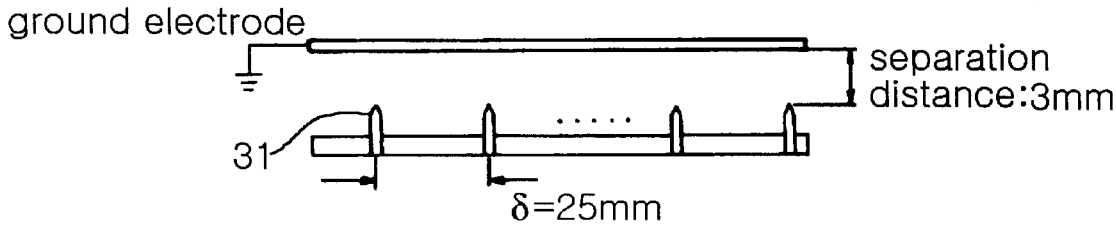
FIGS. 3*a* and 3*b* are side and plan views of discharge electrode assemblies of the static electricity removal apparatus of FIG. 1.
Figure 3B:
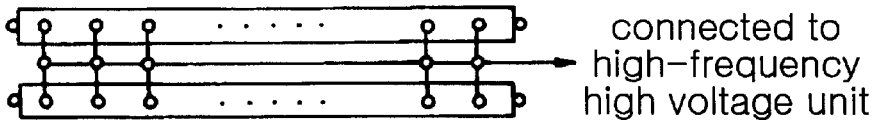

As shown in FIGS. 3*a* and 3*b*, each of the first and second discharge assemblies 12*a* and 12*b* of the air-blowing type static electricity removal apparatus 10 has 8 needle-shaped electrodes 31 aligned with each other at intervals of, preferably, about 25 mm. The first and second discharge assemblies 12*a* and 12*b* may preferably be positioned in such a manner as to be opposed to each other such that ions generated from each of the needle-shaped electrodes 31 are effectively moved to the charged objects 14 by air flow from the fan 11 to the charged objects 14.

Figure 4A:
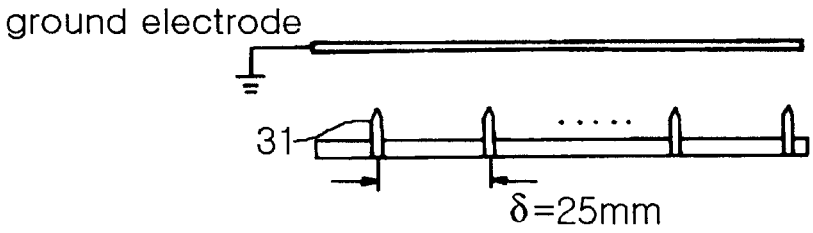
FIGS. 4*a* and 4*b* are side and plan views of a discharge electrode assembly of the static electricity removal apparatus of FIG. 2.
Figure 4B:
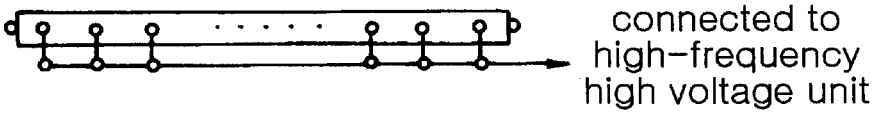

As shown in FIGS. 4*a* and 4*b*, the discharge electrode assembly 21 of the bar type static electricity removal apparatus 20 has 30 needle-shaped electrodes 31 aligned with each other at intervals of about 25 mm.

The needle-shaped electrodes 31 are spaced apart from each other at intervals of preferably about 20~30 mm, most preferably about 25 mm, for the purpose of achieving the maximum ion generation amount and preventing a spark discharge therebetween.

Figure 6A:
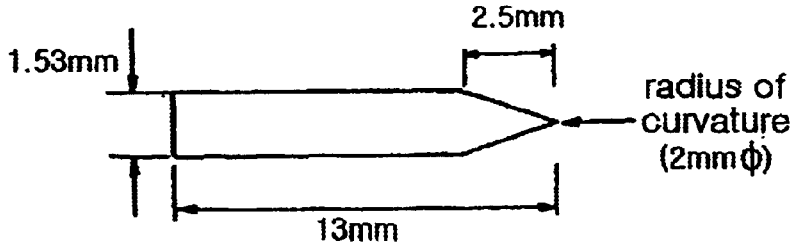
FIGS. 6*a* and 6*b* are side views of a needle-shaped electrode of the static electricity removal apparatus of FIG. 1 or FIG. 2 and a distribution, around the discharge needle, of lines of electric force.

Each of the needle-shaped electrodes 31 included in each of the discharge electrode assemblies 12*a*, 12*b* and 21 has a length of 13 mm and a diameter of 1.53 mm, as shown in FIG. 6*a*, and is made of tungsten (99.95%). In order to optimize an ion generation amount and ion generation range, it is preferable that the end of each of the needle-shaped electrodes 31 has a radius of curvature of 2 mm.

Figure 6B:
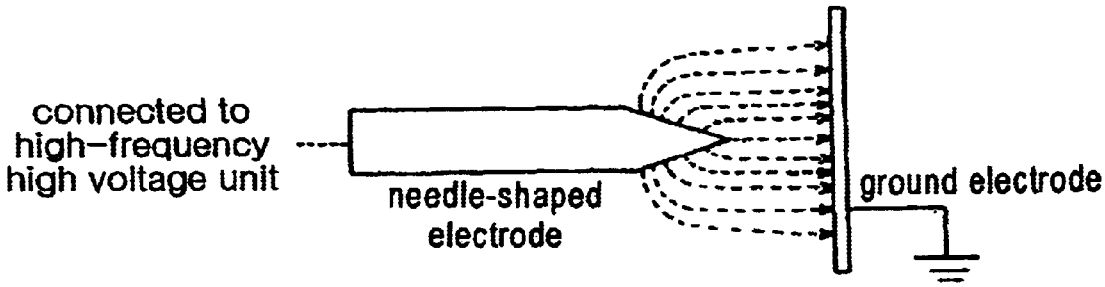

If the high-frequency high voltage AC voltage from the high-frequency high voltage generation unit 13*a*, 13*b* or 22 is applied to the corresponding needle-shaped electrodes 31 having the above described shape, a distribution of lines of electric force is formed in the neighborhood of each of the needle-shaped electrodes 31, as shown in FIG. 6*b*.

Figure 5:
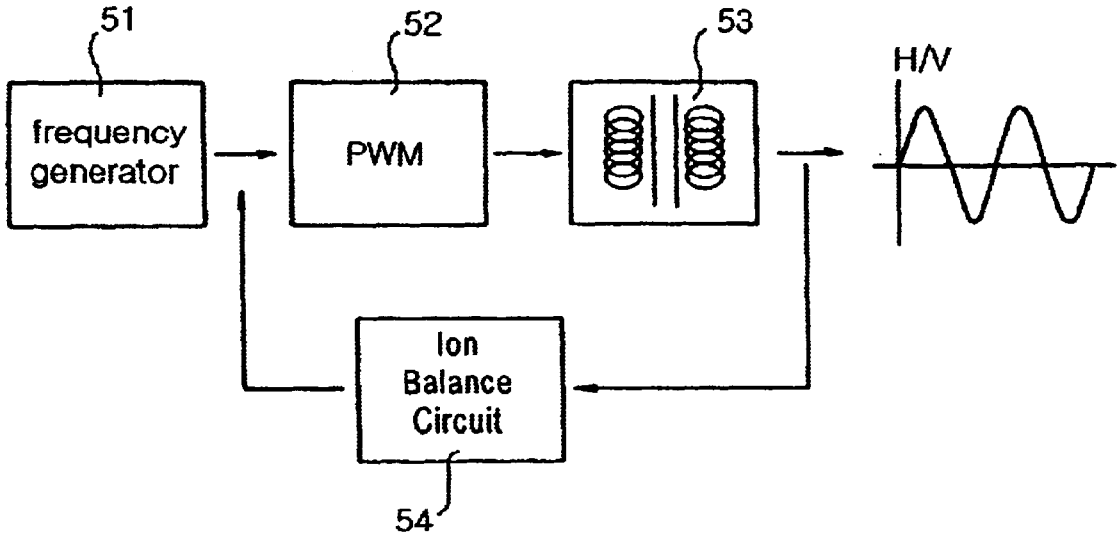
FIG. 5 is a block diagram showing the construction of a high-frequency high voltage generation unit of the static electricity removal apparatus of FIG. 1 or FIG. 2 according to an embodiment of the present invention.

FIG. 5 is a block diagram showing the construction of the high-frequency high voltage generation unit 13*a*, 13*b* or 22 for applying the high-frequency high voltage AC voltage to the corresponding discharge electrode assembly 12*a*, 12*b* or 21.

The high-frequency high voltage generation unit provided in the present invention includes a frequency generator 51 for generating a high frequency signal having a predetermined frequency (for example, 17 KHz) a pulse width modulation circuit 52 for generating a pulse signal on the basis of the high frequency signal from the frequency generator 51, a high voltage generation circuit 53 for boosting the voltage level of the pulse signal from the pulse width modulation circuit 52 to a predetermined voltage level, generating a high-frequency high voltage AC voltage signal and outputting the generated high-frequency high voltage AC voltage signal, and an ion balance circuit 54 for inputting the high-frequency high voltage AC voltage signal fed back from the high voltage generation circuit 53 and providing the pulse width modulation circuit 52 with a compensation value according to an output variation of the high-frequency high voltage AC voltage signal outputted from the high voltage generation circuit 53.

When inputting a compensation signal, or the compensation value, from the ion balance circuit 54, the pulse width modulation circuit 52 adjusts a pulse width of its output pulse signal on the basis of a high frequency signal from the frequency generator 51 in consideration of the compensation signal.

Figure 7:
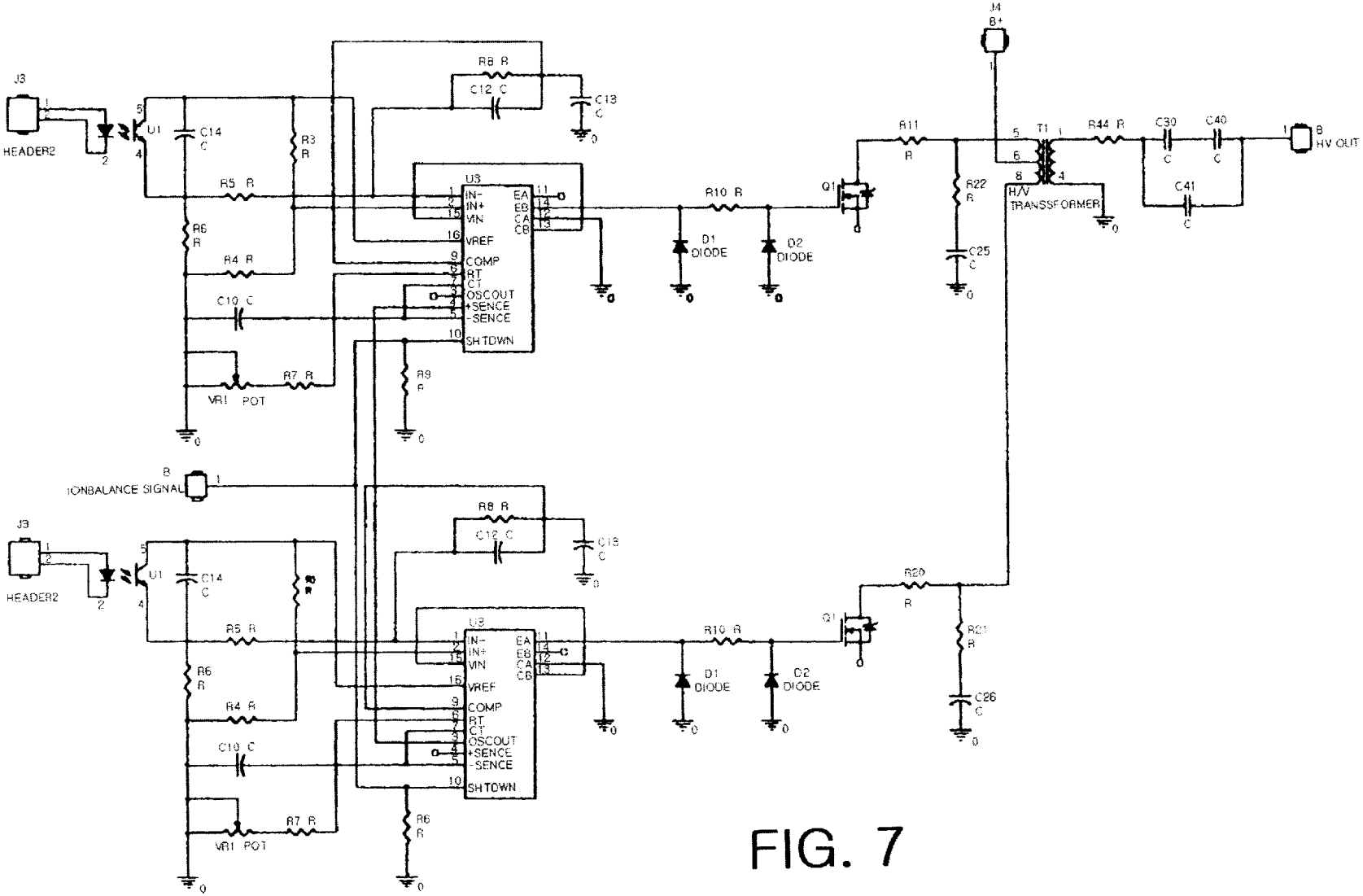
FIG. 7 shows a detailed pulse width modulation (PWM) circuit in the high-frequency and voltage generation unit of FIG. 5 according to an embodiment of the present invention.

FIG. 7 is a detailed circuit diagram illustrating an embodiment of the pulse width modulation circuit 52 and high voltage generation circuit 53. First, headers 1 and 2 J3 are simultaneously provided with high frequency signals from the frequency generator 51. Then, the headers 1 and 2 J3 respectively apply the provided high frequency signals to upper and lower PWM ICs U3 as a clock signal of a certain period through associated photo couplers U1. At this time, the upper and lower PWM ICs U3 are respectively provided with (+) pulse signal and (−) pulse signal from the headers 1 and 2. Then, the upper and lower PWM ICs U3 transfer the provided (+) pulse signal and (−) pulse signal to a transformer T1, respectively. If the (+) pulse signal and (−) pulse signal is applied to the transformer T1, then the transformer T1 outputs a high-frequency high voltage AC voltage through its secondary coil. The high-frequency high voltage AC voltage signal generated in this manner is applied to each of the needle-shaped electrodes of each of the discharge electrode assemblies 12*a* and 12*b* or of the discharge electrode assembly 21, so that ions are generated at a high alternation rate as shown in FIG. 6.

Figure 8:
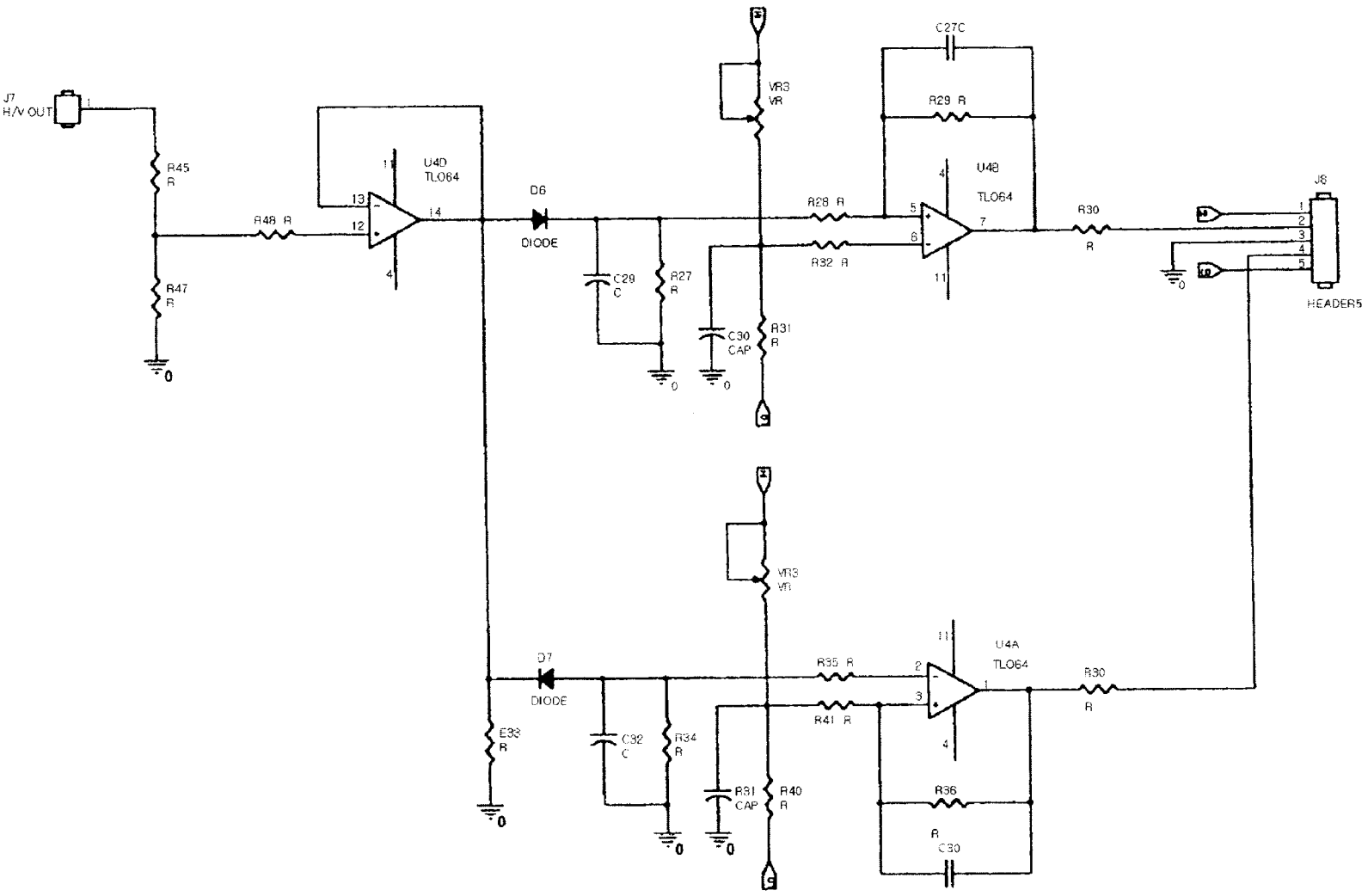
FIG. 8 shows a detailed ion balance circuit in the high-frequency AC voltage generation unit of FIG. 5 according to an embodiment of the present invention.

FIG. 8 is a detailed circuit diagram illustrating an embodiment of the ion balance circuit 54. The ion balance circuit 54 inputs the high-frequency high voltage AC voltage signal through its input terminal J7 connected to an output terminal of the high voltage generation circuit 53. Then, the high-frequency high AC voltage signal inputted to the ion balance circuit 54 is applied to an operational amplifier U4D and then amplified by it. Subsequently, a (+) input terminal of an operational amplifier U4B inputs the amplified AC voltage signal, and a (−) input terminal thereof inputs a reference voltage. The AC voltage signal inputted to the amplifier U4B is integrated by an integration circuit including the operational amplifier U4B and passive elements R29, R30, C27, C30 and so forth. The integrated AC voltage signal is then applied to the pulse width modulation circuit 52 to be used as a compensation signal.

It should be noted that the circuit diagrams of FIGS. 7 and 8 have been taken as examples of circuit configurations for generating the high-frequency high voltage AC voltage signal. However, the present invention is not limited thereto.

As described above, a high-frequency high voltage AC voltage signal generated by the high-frequency high voltage generation unit is applied to the discharge electrode assembly such that a corona discharge occurs around each of the needle-shaped electrodes of the discharge electrode assembly to generate ions. The ions generated in this manner are moved to the charged objects by the wind (a maximum of 0.87 $m^3$/min) from the fan or by air pressure (a maximum of 5 kg/$cm^3$) generated by air injection from the air inlet, and bound to ions causing static electricity on a surface of each of the charged objects, thereby removing the static electricity.

The AC voltage applied to the discharge electrode assembly has a high frequency of 17 KHz. Accordingly, an alternating rate at which the ions are generated becomes high. As a result, the static electricity on the charged objects can be rapidly removed even though each of the charged objects moves at a high speed (a maximum of 50 m/sec).

As apparent from the above description, the present invention provides a static electricity removal apparatus which is capable of raising an alternating rate of ion generation by applying a voltage of a high frequency to a discharge electrode, thereby effectively removing static electricity occurring on charged objects moving at high speeds.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A static electricity removal apparatus comprising:

at least one discharge electrode assembly including a plurality of needle-shaped electrodes aligned with each other, the plurality of needle-shaped electrodes adapted to receive a high-frequency high voltage AC voltage and to generate ions using a corona discharge;

a ground electrode spaced apart from the at least one discharge electrode assembly by a certain interval, the ground electrode adapted to facilitate ion generation by the plurality of needle-shaped electrodes;

a high-frequency high voltage generation unit having a frequency of 17kHz and a maximum voltage of 7000 volts directly connected to the at least one discharge electrode assembly, the voltage generation unit adapted to generate the high-frequency high voltage AC voltage outputted to the plurality of needle-shaped electrodes; and an ion blower adapted to blow ions from the plurality of needle-shaped electrodes to an object requiring static electricity removal.

2. The apparatus as set forth in claim 1, wherein the high-frequency high voltage generation unit comprises:

a frequency generator adapted to generate a high frequency signal of a predetermined frequency band;

a pulse width modulation circuit adapted to generate a pulse signal in accordance with the high frequency signal from the frequency generator and to adjust a width of the pulse signal in accordance with a compensation signal;

a high voltage generation circuit adapted to generate the high-frequency high AC voltage by boosting a voltage level of the pulse signal from the pulse width modulation circuit and to output the high-frequency high voltage AC voltage to the at least one discharge electrode assembly; and an ion balance circuit adapted to receive the high-frequency high voltage AC voltage and to generate the compensation signal by integrating the high-frequency high voltage AC voltage and to output the compensation signal to the pulse width modulation circuit.

3. The apparatus as set forth in claim 1, wherein the ion blower comprises a fan positioned behind the discharge electrode assembly, the fan being arranged to generate an air flow to move the ions generated by the plurality of needle-shaped electrodes to the object requiring static electricity removal.

4. The apparatus as set forth in claim 1, wherein the ion blower comprises an air chamber of a desired volume located behind the discharge electrode assembly and having an air inlet arranged to supply air of a predetermined pressure into the air chamber to move the ions generated by the plurality of needle-shaped electrodes to the object requiring static electricity removal.

5. The apparatus as set forth in claim 1, wherein the at least one discharge electrode assembly comprises two discharge electrode assemblies arranged to be opposed to each other.

6. The apparatus as set forth in claim 1, wherein the plurality of needle-shaped electrodes are aligned with each other and spaced apart at intervals in a range of 20 to 30 mm.

7. The apparatus as set forth in claim 1, wherein an end of each needle-shaped electrode has a radius of curvature on the order of 2 mm.

* * * * *